US008482206B2

(12) United States Patent
Pouvesle et al.

(10) Patent No.: US 8,482,206 B2
(45) Date of Patent: Jul. 9, 2013

(54) TRANSIENT PLASMA BALL GENERATION SYSTEM AT LONG DISTANCE

(75) Inventors: Jean-Michel Pouvesle, Saint Pryve Saint Mesmin (FR); Christophe Cachoncinlle, Tigy (FR); Raymond Viladrosa, Darvoy (FR); Ahmed Khacef, Orleans (FR); Eric Robert, Orleans (FR); Sébastien Dozias, Orleans (FR)

(73) Assignees: Centre National de la Recherche Scientifique (CNRS), Paris (FR); Universite D'Orleans, Orleans (FR)

( * ) Notice: Subject to any disclaimer, the term of this patent is extended or adjusted under 35 U.S.C. 154(b) by 298 days.

(21) Appl. No.: 12/738,072

(22) PCT Filed: Oct. 16, 2008

(86) PCT No.: PCT/EP2008/063978

§ 371 (c)(1),
(2), (4) Date: Oct. 14, 2010

(87) PCT Pub. No.: WO2009/050240

PCT Pub. Date: Apr. 23, 2009

(65) Prior Publication Data

US 2011/0018444 A1 Jan. 27, 2011

Related U.S. Application Data

(60) Provisional application No. 60/999,083, filed on Oct. 16, 2007.

(51) Int. Cl.
*H01J 7/24* (2006.01)

(52) U.S. Cl.
USPC ..... 315/111.21; 315/111.01

(58) Field of Classification Search
USPC ..... 315/111.01, 111.21
See application file for complete search history.

(56) References Cited

U.S. PATENT DOCUMENTS

| | | | | |
|---|---|---|---|---|
| 5,541,385 | A * | 7/1996 | Konkola | 219/121.6 |
| 6,406,759 | B1 | 6/2002 | Roth | |
| 6,831,421 | B1 | 12/2004 | Bletzinger | |

FOREIGN PATENT DOCUMENTS

| | | | |
|---|---|---|---|
| EP | 1 383 359 | A2 | 1/2004 |
| WO | WO-2006/048649 | A1 | 5/2006 |
| WO | 1 383 359 | A3 | 8/2008 |

* cited by examiner

*Primary Examiner* — Thuy Vinh Tran
(74) *Attorney, Agent, or Firm* — Blakely Sokoloff Taylor & Zafman

(57) ABSTRACT

A new device based on very short pulsed discharges, generating plasmas balls and plumes over very long distances (up to several meters). These plasma balls travel in a dielectric guide at the end of which there is generation of an apparent plasma plume like zone, with a shape and intensity dependent on the discharge repetition rate. A secondary mixture plasma can be produced close to a given surface by adding other gas fluxes in the main gas stream. The plasma balls can be generated in gases at a repetition rate in the range from single shot to multi-kilohertz.

7 Claims, 3 Drawing Sheets

TRANSIENT PLASMA BALL GENERATION SYSTEM AT LONG DISTANCE

This is a non-provisional application claiming the benefit of U.S. Provisional application No. 60/999,083, filed Oct. 16,2007, and International application No. PCT/EP2008/063978 filed Oct. 16,2008

FIELD OF THE INVENTION

The invention relates to an apparatus generating on very short pulsed discharge basis plasma balls and plumes at long distances and under atmospheric pressure.

BACKGROUND OF THE INVENTION

Plasma is typically an ionised gas. The term "ionised" refers to presence of free electrons, which are not bound to an atom or molecule. The free electrons make the plasma conductive so that it responds strongly to electromagnetic fields.

Plasma is commonly used in plasma displays (including TVs), fluorescent lamps (low energy lighting), neon signs, fusion energy research, electric arc in an arc lamp, arc welder or plasma torch, etch dielectric layers in the production of integrated circuits. Usually plasma is generated by a periodical signal (for example a sinusoidal signal). But in this case the generation can be controlled (triggered in a single shot for example).

Among the new plasma technology applications, plasma for medicine and biology are the most rising. The demonstration of spectacular effects in the treatment of diseases of the skin or very encouraging results on changes in the behaviour of the tumor cells are in the process of literally explode research in this area, like all processes concerning the processing of materials in the framework of the implementation of biocompatible surfaces. For these reasons, there is an increase interest for generation of atmospheric plasma plumes or "needles" for use in sterilization and decontamination, skin and tumor treatment, or dental care. In most cases the discharge device generating the plasma medium is at short distances of several centimeters or very close to the surface to be treated due to plasma production (direct DBD) or due to the rather rapid extinction of the plasma plume travelling in air.

SUMMARY OF THE INVENTION

The present invention concerns a plasma generation system that allows control and trigger of the generated plasma.

The present invention also includes an apparatus that can generate plasma balls moving at very high speeds over distances of up to several meters in gas pressures ranging from one atmosphere (or less) to several atmospheres and decoupled from original plasma.

The plasma travels in a guide that may be of any shape or in an open gas volume (for example in open air).

Another aspect of the invention is to provide an apparatus generating atmospheric plasma plumes, having a flexible extension that can be easily held in hand and whose flexibility allows access in difficult zones (for example medical treatment in difficult access zones).

Yet another aspect of the invention is to generate plasma plumes over long distances and to allow modifications of plasma plumes characteristics.

Still another aspect of the invention is to provide an ultra-fast-high-voltage plasma switch with a high or low current (switching time of less than several nanoseconds) controlled remotely.

Other objects, advantages and applications of the present invention will become apparent to those skilled in the art when the following description of the best mode contemplated for practicing the invention is read in conjunction with the accompanying drawings.

The present invention accomplishes these objects by providing a plasma ball generation device comprising a dielectric barrier, the dielectric barrier comprising:

- a discharge cell made entirely in insulating materials,
- two or more electrodes arranged in the discharge cell, the discharge cell being filled with high pressure gas and wherein a electrical discharge is generated between the two electrodes, the discharge duration being sub-microsecond.

Preferably but optionally, the invention has at least one of the following features:

- the discharge duration is sub-nanoseconds,
- an outlet of the cell is connected to an insulating guide,
- the guide comprises a secondary material inlet,
- the guide comprises dielectric wall,
- the cell comprises a gas inlet connected with a gas source,
- at least one of the electrodes is connected to the gas through a dielectric barrier,
- both of the electrodes are connected to the gas through a dielectric barrier,
- at least one of the electrodes is split in several pieces to enable a synchronisation.

The invention also concerns an ultra-fast switch device comprising:

- a plasma ball generation device according to the invention,
- two electrodes arranged along the guide so as to be electrically connected by a plasma ball generated by the plasma ball generation inside the guide.

BRIEF DESCRIPTION OF THE DRAWINGS

The description herein makes reference to the accompanying drawings wherein like reference numerical refer to like apparatus elements throughout the several views, and wherein.

DESCRIPTION OF THE PREFERRED EMBODIMENTS

The system consists of a generating apparatus and a flexible dielectric guide, whose length can vary from a few centimeters to several meters. At its end, a grip system can be fixed so that the guide can be held in hand or can be mechanically manipulated.

Figure 1:
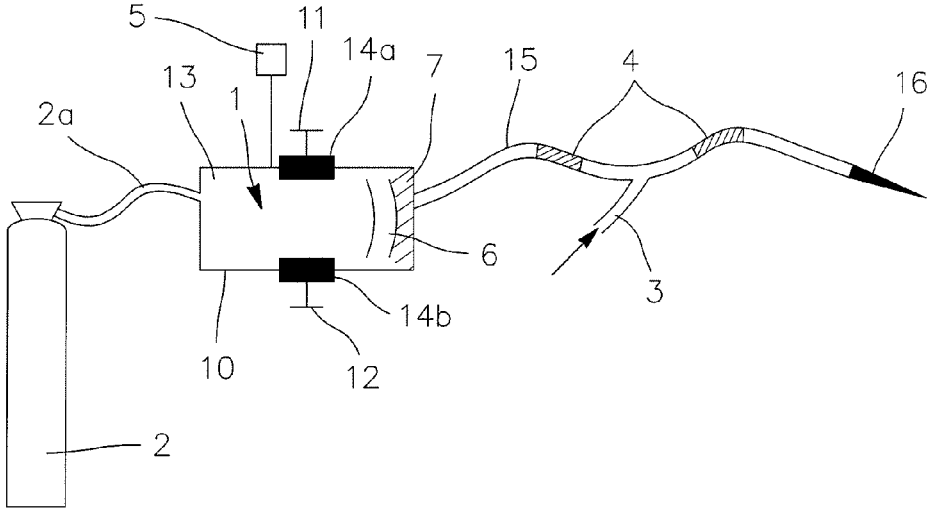
FIG. 1 is a schematic representation of an embodiment of the present invention.

In reference to FIG. 1, the generating apparatus consists of an electric discharge 1 comprising a high-pressure discharge cell 10 (few hundred Torr to a few thousand Torr) made entirely in insulating materials. The cell 10 is filled with gas 13 provided by a gas inlet 2*a* connected with a gas source 2, which can be of any type of gas. Advantageously the gas is a mix gas with elements chosen among noble gas, specially neon or helium. The discharge 1 also comprises electrodes 14*a* and 14*b* connected to a potential 12 and to a potential 11 with a high voltage (positive or negative) between them.

Figure 5A:
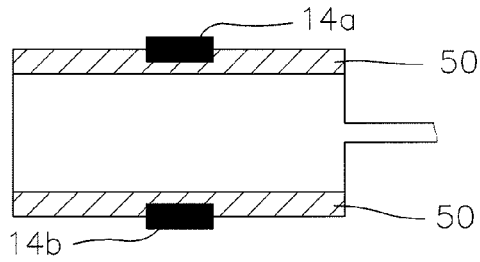
FIG. 5*a* to 5*c* are schematic representations of the discharge cell according the present invention.
Figure 5B:
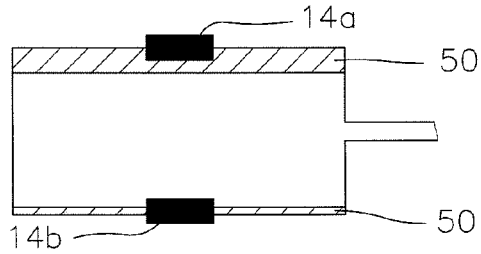
Figure 5C:
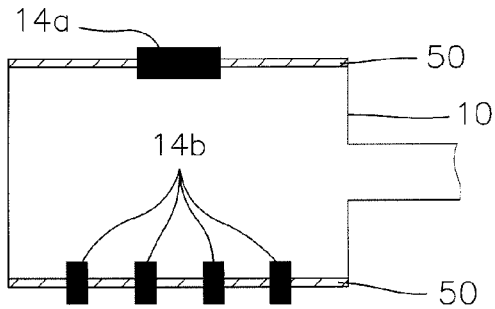

In reference to FIGS. 5*a* to 5*c*, the discharge configuration is either a direct discharge through metallic electrodes 14*a* and 14*b* or any of the two following so called dielectric barrier setup (DBD standing for Dielectric Barrier Discharge): double barrier discharge cell, where both of the metallic electrodes 14*a* and 14*b* are connected to the gas through a dielectric barrier 50, and single barrier discharge, where only one of the electrodes 14*a* is covered by a dielectric barrier layer 50. One electrode 14*b* (or both) can be split in several pieces so as to enable a synchronisation (electrode pieces powered one after the other) trough the discharge cell 10.

Electrodes also can be split in several pieces to layout pieces around the cell 10.

The discharge 1 is controlled by a control system 5 to have a very high electric field and a voltage rising (or a voltage dropping) very quickly (sub-microsecond and preferably from nanoseconds to ten nanoseconds) from null to few tens of kilovolt. In consequence, an extremely fast ionization front wave 6 is created inside the gas 13.

Thus the discharge cell 10 is pulsed powered by sub-microsecond voltage waveforms, having a fast rising voltage edge. This later condition is essential for the efficient generation of high speed ionization front wave 6. The discharge can be operated in single shot mode (single voltage pulse), in repetitive mode up to high frequency regimes (in the kHz range), and in burst mode (a few voltage pulses delivered at very high frequency, multi kHz range).

In that way, the system 5 can control the energy released. This is not the case of conventional devices that create atmospheric plasma plumes: they work on repetitive patterns at very high frequency, but neither in single shot nor low frequency. The plasma ball production is controlled through the pulse forming setup and can be synchronized with a jitter as low as a few nanoseconds with any other machine, eventually a second plasma ball generator.

This wave of ionization 6 moves very quickly and the speed depends on the concentration obtained in the electronic environment. This ionization wave 6 involves plasma 7. The plasma duration depends on the conditions under which it has been created. It is pretty much equal to the duration of the high-voltage discharge.

If the end of a guide 15, made of insulating material that can contain or transport gas, is connected to the discharge cell 10 next to the plasma 7, a plasma "ball" 4 can circulate into the guide 15. The guide 15 acts as a guide for plasma balls and, after a course of any form, to bring it to a desired location.

The combination between the discharge barrier (formed by the discharge cell and the electrodes) and the guide, the discharge cell being filled with high pressure gas and a pulsed electrical discharge being generated between the two electrodes, allows generating plasma balls moving at very high speeds over distances of up to several meters.

Once launched, created plasma ball 4 is "autonomous" meaning that it does not depend electrically on original plasma 7 anymore. Along the output guide 15, the plasma ball 4 travels independently from the original plasma 7 generated in the discharge cell 10. The plasma ball is thus electrically insulated from the high voltage plasma generated. The plasma ball is first likely to travel through the gas volume inside of the dielectric guide connected with the plasma discharge cell 10. It has to be noted that these plasma balls 4 can be generated at a pressure of several atmospheres (or at a very low pressure). In neon, depending on conditions of discharge (energy injected in the plasma source, gas pressure, gas flow and distance from original plasma) plasma ball 4 speed may range from 10 km/s to 1000 km/s.

Insofar as the plasma does not meet conductive elements, it can move into the environment up to its auto-extinction. To control the plasma in a course of given length, a conductive element can be connected to the ground potential (or a predetermined potential) at the desired distance.

The ball properties, time duration and propagation speed, can be controlled by the design of the discharge cell. The length of the discharge cell or the pulse power waveform temporal profile can for instance be shaped for the production of a specific plasma ball.

Figure 6:
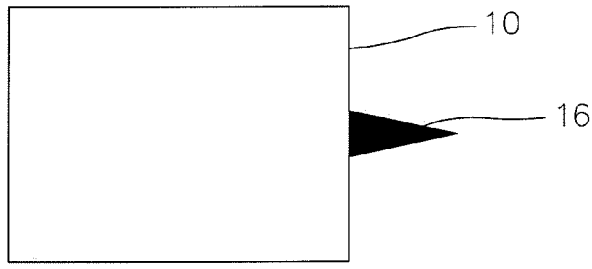
FIG. 6 is a schematic representation of a third embodiment of the present invention.

When a plasma ball 4 is released to open air, it generates a plasma plume 16 that can reach several centimeters, depending on the conditions of discharge. In fact, when the plasma ball 4 comes out of the dielectric guide 15, it expands in a mixture of the gas filling the guide and ambient air and generates a reactive plasma plume 16. The plasma plume 16 can thus be produced at large distances from the discharge cell 10 by the use of an easy-to-handle dielectric guide. The development of a cold plasma plume at atmospheric pressure may find applications in medicine, biology, decontamination, sterilisation and plasma-surface process. The short duration and high speed plasma ball may also be of interest for the development of a new plasma based high voltage switch for pulsed power technologies as we will see later. In reference to FIG. 6, the plasma plume can be released directly outside the discharge cell (without any guide 15).

The gas can be static or dynamic depending on its flow. Plasma balls and plumes characteristics (speed, shape, projection distance) depend on gas flow.

Moreover, the plasma ball 4 may interact with another plasma ball, or with various materials (gas, fluid, liquid, powder, particles, . . . ), before giving birth to the plasma plume 16. In this way, the plasma plume 16 may contain reactive species matched to a specific application.

So the guide 15 can be equipped with a secondary material inlet 3 which allows modifications of the plasma composition (chemical composition and/or physical characteristics) according to the needs or the application.

Figure 2A:
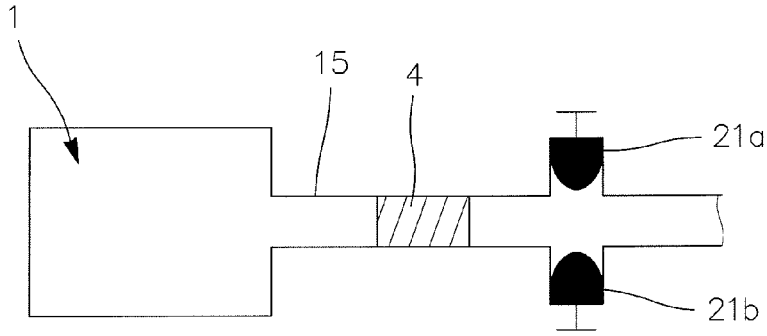
FIGS. 2*a* and 2*b* are schematic representations of a second embodiment of the present invention.
Figure 2B:
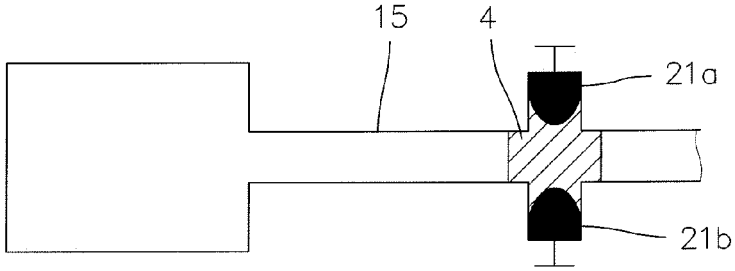

In reference in FIGS. 2*a* and 2*b*, the apparatus comprises two electrodes 21*a* and 21*b* that allow above-described high-speed plasma balls 4 to be used to close remotely an electrical circuit that can involve strong currents and high voltages. The plasma balls 4 are used to strongly drop resistance between the electrical contacts or electrodes 21*a* and 21*b*. The switching time is less than three nanoseconds. This system allows remote switching circuits involving high currents (several kA) with no electrical coupling with the trigger element.

Figure 3A:
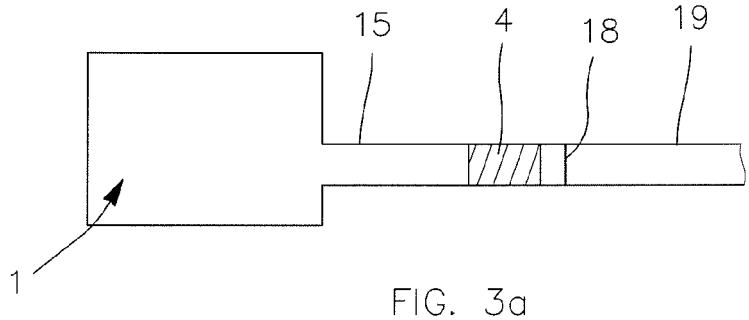
FIGS. 3*a* and 3*b* are schematic representations, explaining a plasma ball generation through a dielectric wall according the present invention.
Figure 3B:
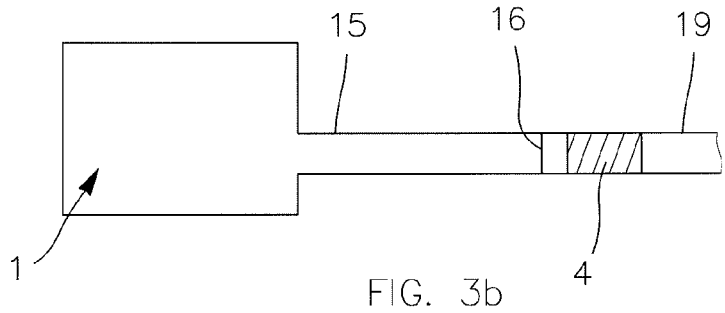

In the above-described case, the gas in the dielectric guide and the switch guide is the same, but it can also work with two different gases. In reference to the FIGS. 3*a* and 3*b*, the ionisation wave can still go through a thin dielectric wall 18, insulating the gas from the generator and gas of the switch. This double guide system works also for a plumes generation system as described previously.

Figure 4:
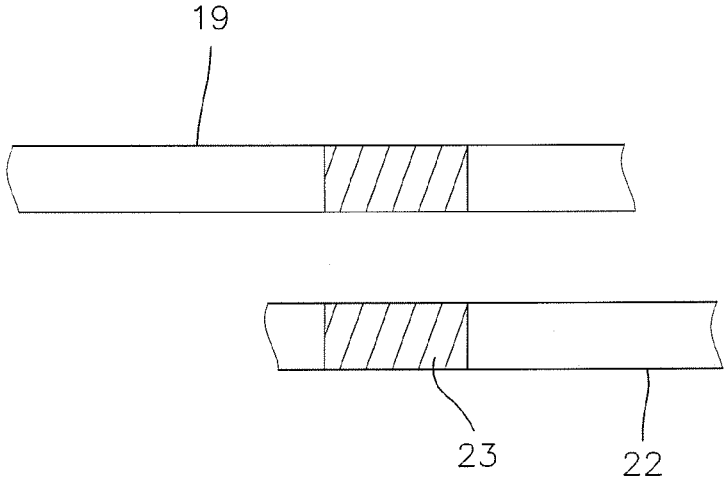
FIG. 4 is a schematic representation, explaining a plasma ball generation in a parallel guide according the present invention.

It creates a plasma ball in the switching guide 19 leading to the same result than previously. This allows choosing the gas according to switch voltages. In reference to FIG. 4, a ball of plasma 20 can create another ball of plasma 23 in another gas inside another dielectric guide 22 in parallel to the first dielectric guide 19.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of appended claims, which scope is to be accorded the broadest interpretation so as to encompass all such modifications and equivalent structures as is permitted under the law.

The invention claimed is:

1. A plasma ball generation device comprising a didecthc barrier, a discharge cell made entirely in insulating materials, two or more electrodes arranged in the discharge cell, the discharge cell being filled with a high pressure gas and wherein an electrical discharge is generated between the two or more electrodes at a discharge duration of submicroseconds, wherein an outlet of the cell is connected to an insulating guide, and the insulating guide includes a secondary material inlet.

2. The plasma ball generation device according to claim 1, wherein the discharge duration is subnanoseconds.

3. The plasma ball generation device according to claim 1, wherein the guide comprises a dielectric wall.

4. The plasma ball generation device according to claim 1 , wherein the cell comprises a gas inlet connected to a gas source.

5. The plasma ball generation device according to claim 1, wherein at least one of the electrodes is connected to the gas through the dielectric barrier.

6. The plasma ball generation device according to claim 1, wherein at least one of the electrodes is split in several pieces to enable a synchronisation.

7. The plasma ball generation device according to claim 1, wherein the two or more electrodes are arranged along the guide so as to be electrically connected by a plasma ball generated by the plasma ball generation inside the guide, to form an ultra-fast switch device.

* * * * *

UNITED STATES PATENT AND TRADEMARK OFFICE

CERTIFICATE OF CORRECTION

PATENT NO. : 8,482,206 B2
APPLICATION NO. : 12/738072
DATED : July 9, 2013
INVENTOR(S) : Jean-Michel Pouvesle et al.

It is certified that error appears in the above-identified patent and that said Letters Patent is hereby corrected as shown below:

In the Claims, Column 5, Claim 1, line 9, please delete "didecthc" and insert --dielectric--.

Signed and Sealed this
First Day of October, 2013

Teresa Stanek Rea
*Deputy Director of the United States Patent and Trademark Office*